US006746011B2

(12) United States Patent
Miller et al.

(10) Patent No.: US 6,746,011 B2
(45) Date of Patent: Jun. 8, 2004

(54) SHEET SEPARATING AND FEEDING WITH VARIABLE POSITION STACK EDGE FLUFFING

(75) Inventors: Eugene F. Miller, Fairport, NY (US); Joseph Marasco, Fairport, NY (US); William D. Milillo, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/165,708

(22) Filed: Jun. 7, 2002

(65) Prior Publication Data

US 2003/0227122 A1 Dec. 11, 2003

(51) Int. Cl.[7] ..... B65H 3/14

(52) U.S. Cl. ..... 271/97; 271/162; 271/164; 271/105

(58) Field of Search ..... 271/97, 162, 164, 271/105

(56) References Cited

U.S. PATENT DOCUMENTS 4,060,234 A * 11/1977 Motoyama ..... 271/164
5,110,110 A * 5/1992 Wirz et al. ..... 271/98
5,253,015 A * 10/1993 Morita et al. ..... 399/13
5,292,116 A * 3/1994 Inoue et al. ..... 271/157
5,344,133 A * 9/1994 Jantsch et al. ..... 271/94
5,921,540 A * 7/1999 Acquaviva et al. ..... 271/98
6,015,144 A * 1/2000 Yoshii et al. ..... 271/97
6,186,492 B1 2/2001 Dechau et al.
6,264,188 B1 7/2001 Taylor et al.
6,352,255 B1 3/2002 Taylor

FOREIGN PATENT DOCUMENTS

DE 3616804 A1 * 11/1987 ..... B65H/1/20
JP 04023747 A * 1/1992 ..... B65H/3/48

* cited by examiner

*Primary Examiner*—Donald P. Walsh
*Assistant Examiner*—Matthew J. Kohner

(57) ABSTRACT

For printer sheet separating and feeding with stack side edge air fluffing assistance from variable size sheet stacks in a sheet feeding tray with at least one repositionable stack side edge guide in an openable machine drawer, the stack edge fluffer system automatically operatively engages the edge guide to provide a preset spacing from the variable side edge positions of various size stacks when said machine drawer is closed, plus an air baffle extension out over the stack, but automatically disengages to provides unobstructed loading when the drawer is opened. It may include an automatically variable length manifold.

7 Claims, 4 Drawing Sheets

SHEET SEPARATING AND FEEDING WITH VARIABLE POSITION STACK EDGE FLUFFING

Disclosed in the embodiments herein is an improved system for separating and individually feeding sheets, especially print media paper sheets of varying sizes and weights, more reliably from a stack of sheets, with an improved, variable position, stack edge pneumatic fluffer.

By way of background, the use of stack edge fluffers or air knives to help separate and/or levitate sheets for improved sheet separation and feeding is an extensively developed art, with numerous patents. The following are noted by way of some recent examples of Xerox Corp. U.S. patents with disclosures of such systems, and for other such art cited therein: U.S. Pat. No. 6,186,492 issued Feb. 13, 2001 to Dechau, et al; U.S. Pat. No. 6,264,188 issued Jul. 24, 2001 to Taylor, et al; and U.S. Pat. No. 6,352,255 issued Mar. 5, 2002 to Taylor. Said U.S. Pat. No. 6,186,492 also discloses an example of a reciprocating vacuum feed head or "shuttle feeder," with which the present embodiment may be desirably combined, but is not limited thereto. Sheet fluffers may also be combined in the same sheet separator/feeder system with what may be alternatively called "air knives" blowing against at least the upper portion of the front, feeding out, or downstream edge of the stack in coordination with the individual sheet acquisition and feeding. Stack fluffing and/or vacuum sheet feeding is particularly desirable for higher speed printing systems, for providing more reliable high speed sheet separation and feeding and also for reduced marking or scuffing of sheet surfaces as compared to "friction retard" or other such sheet separator/feeders which are more commonly used on slower, lower cost, printers.

As used herein, the term "printers" will be understood to broadly include copiers, printers, multifunction devices, etc., with xerographic, ink jet, or other print media printing systems. The term "sheet" as used herein refers to various print media sheets, of various sizes and weights, typically relatively thin, flexible or even flimsy paper, and sometimes even plastic (such as for overhead transparencies).

As is well known in the art, separating individual print media sheets from a stack of sheets reliably, with a very low rate of misfeeds or double-feeds, which can "jam" the printer, is difficult. Paper sheets may have variable sizes, variable curl, variable moisture content, variable thickness, variable weight, variable beam strength, variable surfaces, e.g., glossy or calendared, variable friction, etc. The sheets may even be "edge welded" together from their stack size cutting or brake operation. It may also be desirable to acquire and feed smaller sheets even faster than larger sheets to reduced pitch space between sheets and effectively increase the print rate. Also, sometimes partially preprinted sheets are loaded into an input sheet feed tray from overprinting or duplex (opposite side) printing. Such sheets may have toners, inks or fuser oils on them, or induced curls, further changing their properties and posing additional separation and feeding challenges.

It will also be appreciated that various types of variously slide-mounted or otherwise movable stack edge guides are well known in the art, for various sheet stacking trays, and need not be described in any detail herein. Such edge guides can be reset to the size of the stack of sheets currently being loaded into that tray generally confine the sheets between such guides. The stack side guides can also assist in linear sheet feeding of the sheets in the orthogonal feeding direction. One, or both, opposing side guides may be movable. If both side guides are moveable they may optionally be ganged for coordinated movement towards or away from one another by a rack and pinion connection, as is also well known. E.g., Xerox Corp. U.S. Pat. Nos. 5,511,771 and 5,946,527. This allows for a "center registered" sheet feeding system instead of an "edge registered" system. An "edge registered" system is shown (modified) from FIG. 3 of Xerox Corp. U.S. Pat. No. 6,302,390, and as shown need only have one side guide. In a "center registered" sheet feeding system in which the side guides are so ganged the operator resetting movement of one side guide automatically moves the opposing side guide.

A movable stack end guide may also be additionally provided in sheet feeding trays, opposite from the feed-out end of the stack, movable in the process direction. It may also be movable an angle thereto for substantially centering on the ends of different widths of sheet stacks, as in Xerox Corp. U.S. Pat. No. 6,302,390, the Xerox Corp. "iGen3" product, and FIG. 3.

A specific feature of the specific embodiment disclosed herein is to provide a sheet feeding system for separating and feeding individual print media sheets in a process direction from a variable size stack of print media sheets loaded into a sheet feeding tray having at least one stack side edge alignment guide movable for alignment with said variable sizes of stacks of print media sheets, which sheet feeding tray is in a machine drawer which is openable for said loading of said variable size stacks of print media sheets into said sheet feeding tray, and which machine drawer is closable to allow said and feeding of said individual print media sheets from said sheet feeding tray in said process direction, the improvement comprising a pneumatic stack edge fluffer system for pneumatically assisting said separating and feeding of said individual print media sheets from said sheet feeding tray in said process direction, said pneumatic stack edge fluffer system automatically operatively engaging a side edge of said variable size stack of print media sheets in said sheet feeding tray in variable positions when said machine drawer is closed, and said pneumatic stack edge fluffer system automatically operatively disengaging a side edge of said variable size stack of print media sheets in said sheet feeding tray when said machine drawer is open.

Further specific features disclosed in the embodiment herein, individually or in combination, include those wherein said engagement and disengagement of said pneumatic stack edge fluffer system is cooperative with said movement of said at least one stack edge alignment guide, and/or wherein said pneumatic stack edge fluffer system comprises a telescoping and spring loaded pneumatic manifold mounted in said machine and extending toward said edge of said variable size stack of print media sheets loaded into said sheet feeding tray, and/or wherein said pneumatic stack edge fluffer system includes an extension member extending out over a portion of the upper surface of said stack of print media sheets when said machine drawer is closed, and/or wherein, when said machine drawer is closed, said pneumatic stack edge fluffer system is automatically engaged by said at least one stack edge alignment guide to automatically maintain a preset operative spacing of said pneumatic stack edge fluffer system from the side edge of said stack of print media sheets irrespective of the repositioning of said stack edge alignment guide, and/or a sheet feeding method for separating and feeding individual print media sheets in a process direction from a variable size stack of print media sheets loaded into a sheet feeding tray having at least one stack side edge alignment guide movable for alignment with said variable sizes of stacks of print media sheets, which sheet feeding tray is in a machine drawer which is openable for said loading of said variable size stacks of print media sheets into said sheet feeding tray, and which machine drawer is closable to allow said separating and feeding of said individual print media sheets from said sheet feeding tray in said process direction, the improvement comprising pneumatically assisting said separating and feeding of said individual print media sheets from said sheet feeding tray in said process direction with a stack edge fluffer system by automatically operatively engaging a side edge of said variable size stack of print media sheets in said sheet feeding tray in variable positions with said stack edge fluffer system when said machine drawer is closed, and automatically operatively disengaging said pneumatic stack edge fluffer system from said side edge of said variable size stack of print media sheets in said sheet feeding tray when said machine drawer is open, and/or wherein an air deflector for said pneumatic stack edge fluffer system is automatically extended out over a portion of the upper surface of said stack of print media sheets when said machine drawer is closed, and automatically not extended out over a portion of the upper surface of said stack of print media sheets when said machine drawer is opened to automatically provide unobstructed loading of said print media sheets into said sheet feeding tray and/or wherein, when said machine drawer is closed, said pneumatic stack edge fluffer system is automatically engaged by said at least one stack edge alignment guide to automatically maintain a preset operative spacing of said pneumatic stack edge fluffer system from the side edge of said stack of print media sheets irrespective of the repositioning of said stack edge alignment guide.

As to specific components of the subject apparatus or methods, or alternatives therefor, it will be appreciated that, as is normally the case, some such components are known per se in other apparatus or applications, which may be additionally or alternatively used herein, including those from art cited herein. All references cited in this specification, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example below, and the claims. Thus, the present invention will be better understood from this description of this specific embodiment, including the drawing figures (which are approximately to scale) wherein:

Figure 1:
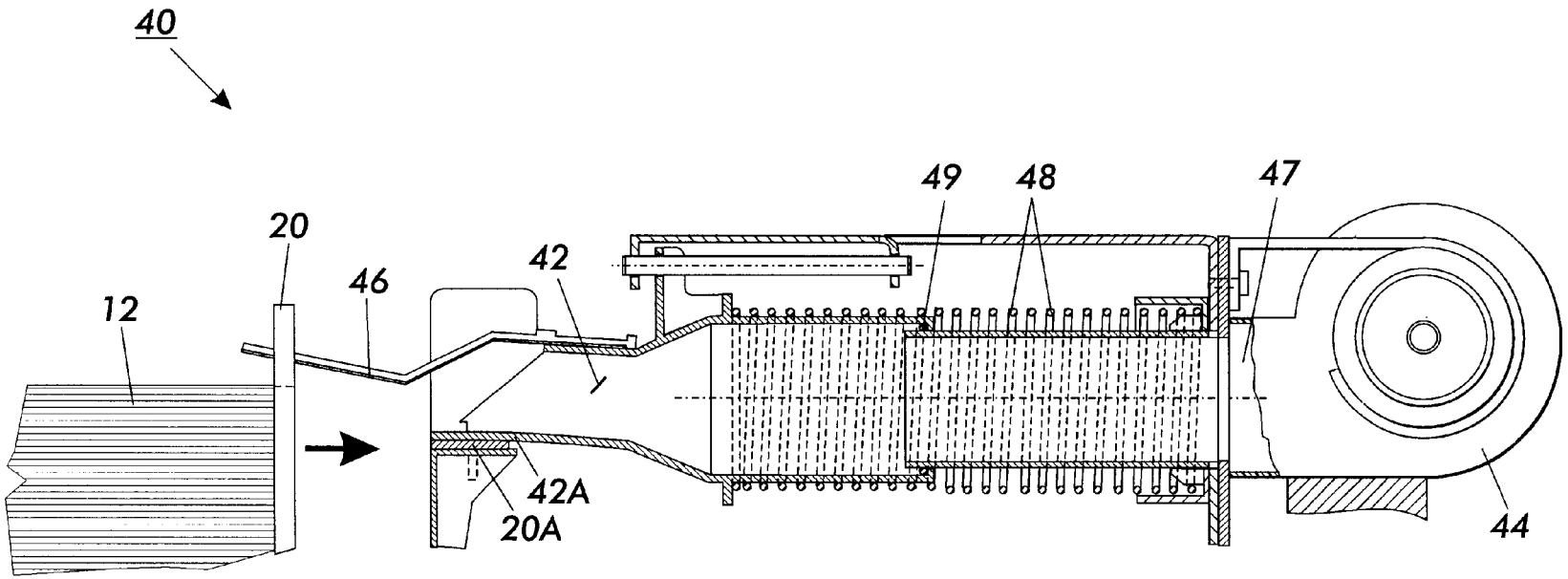
FIG. 1 is a cross-sectional side view of one example of a subject stack side edge fluffer system before operatively engaging (being separated from by drawer opening) a partially shown exemplary stack of print media sheets and an exemplary side edge guide (better illustrated in FIG. 4)
Figure 2:
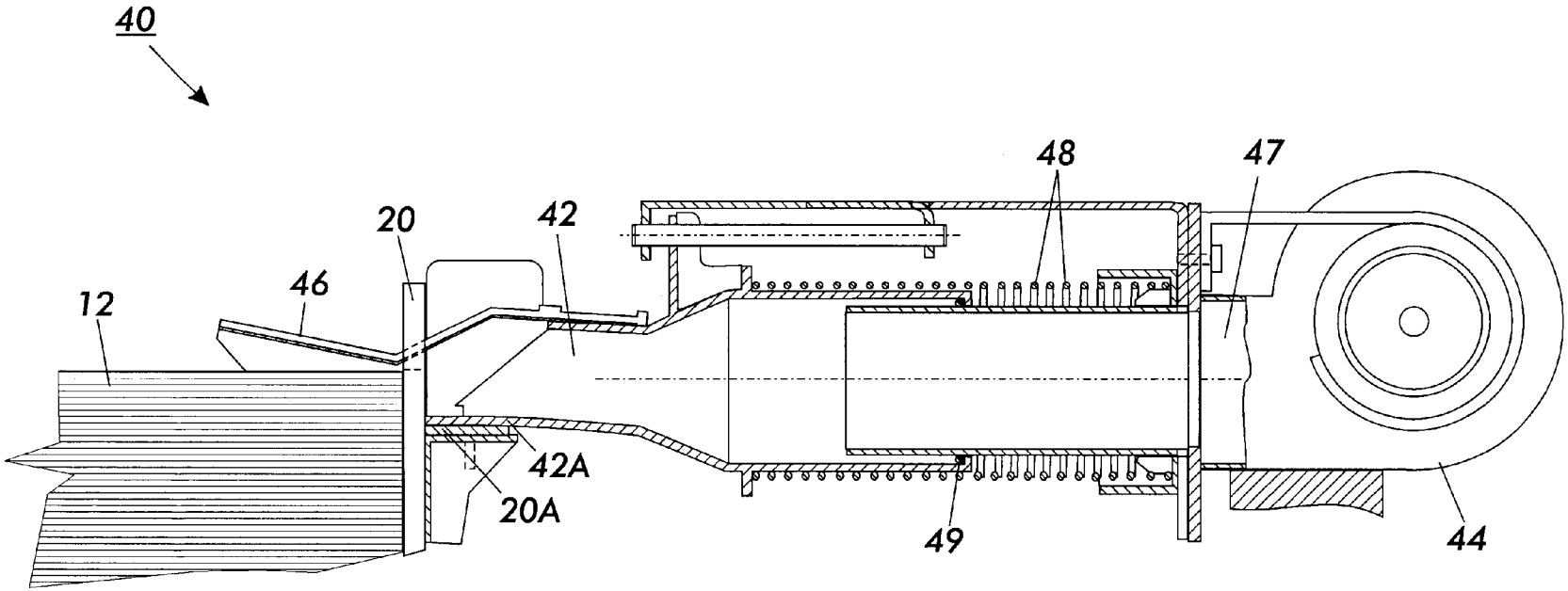
FIG. 2 is the same illustration of FIG. 1 but in an operative position with the drawer closed.
Figure 3:
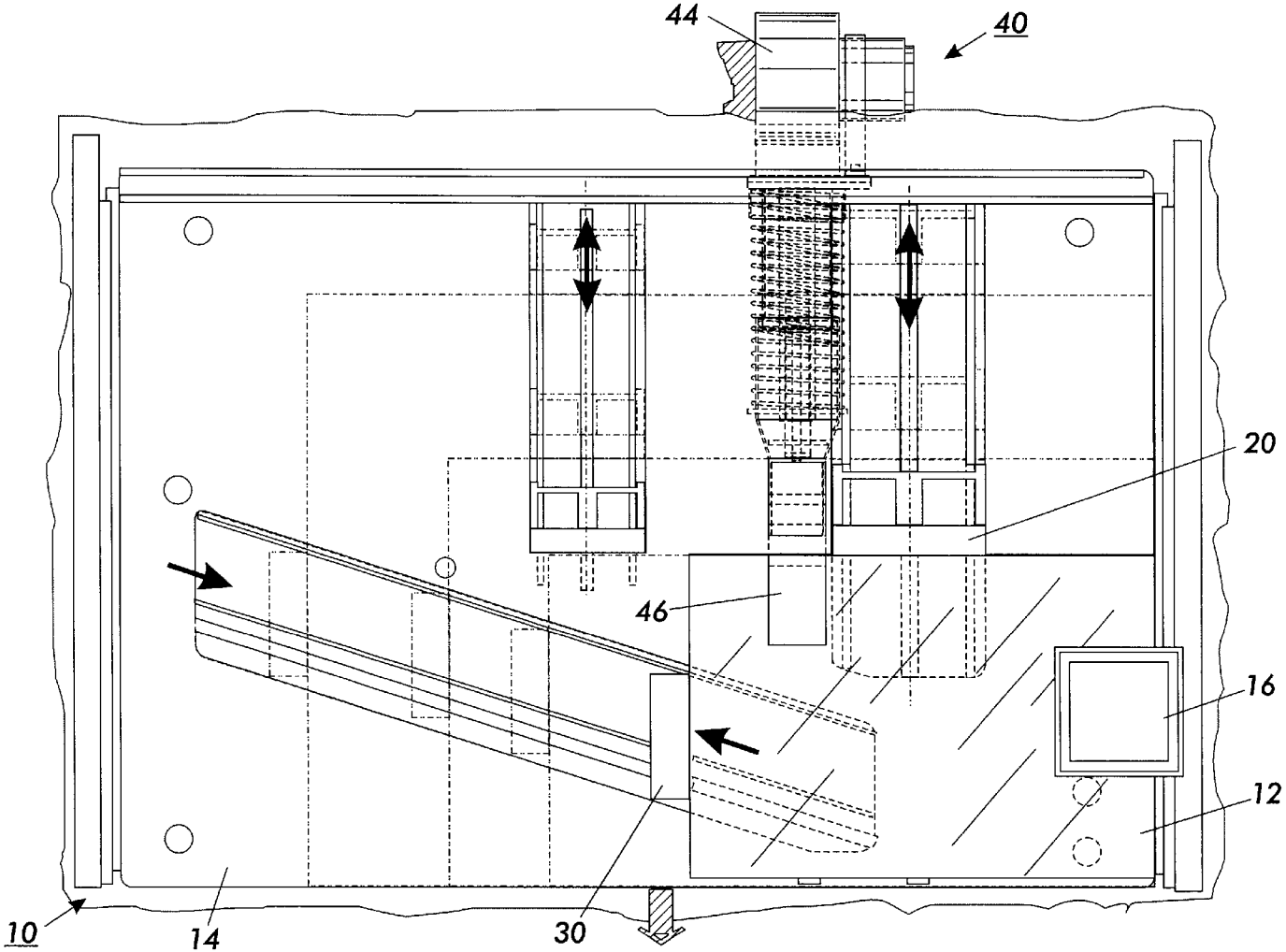
Figure 4:
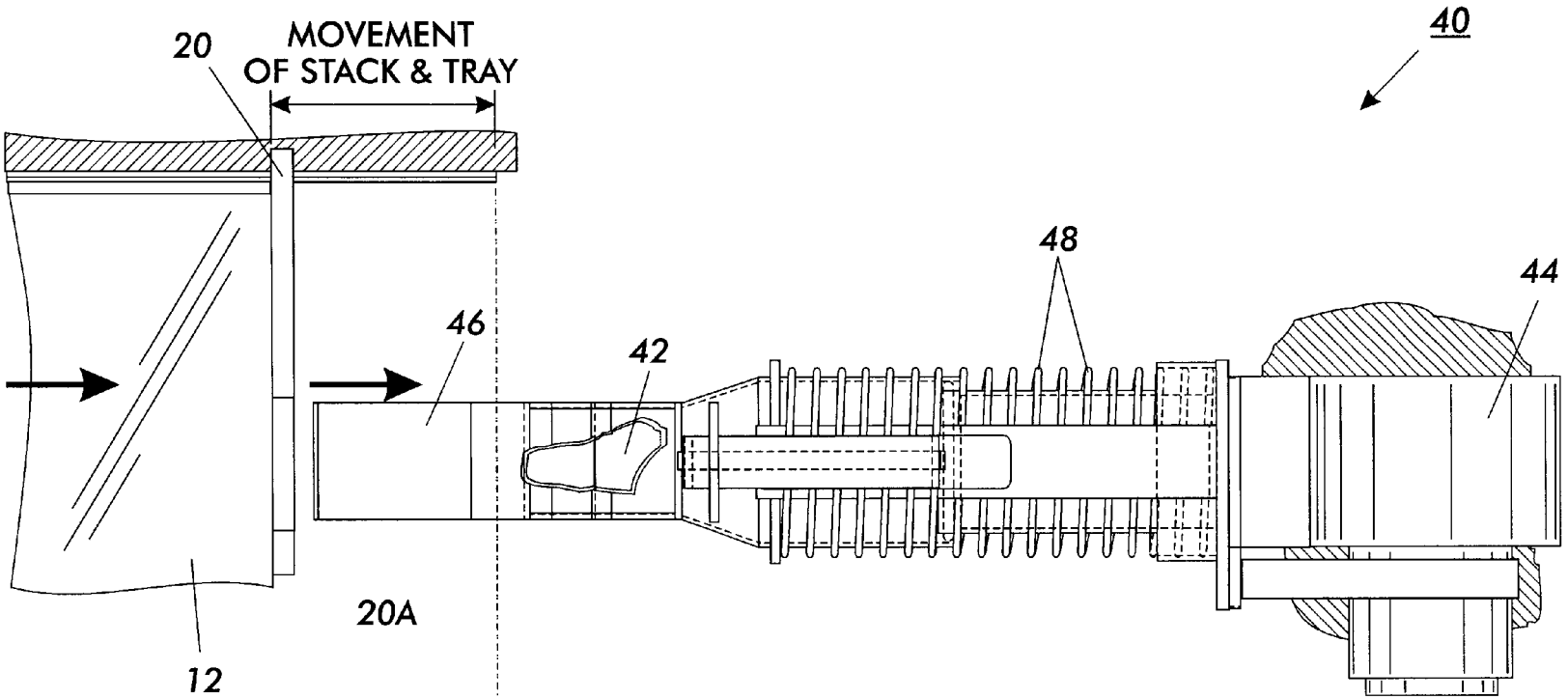

FIG. 3 is a top view of one exemplary drawer-mounted print media sheet feed tray and its side and end guides, of the above-cited U.S. Pat. No. 6,302,390, illustrating utilization therein of the embodiment of FIGS. 1, 2 and 4; and FIG. 4 is a top view of just the stack side edge fluffer system and side guide of FIG. 1.

Describing now in further detail the exemplary embodiment with reference to the Figures, there is shown in FIG. 3, etc., one example of a sheet feeding drawer 10 for a printer which the operator opens to load in additional, or replacement, sheets of a desired size of print media to stack 12 in a sheet feeding tray 14 for feeding sheets individually with a sheet feeder 16 to a printer for printing them. As is well know, the drawer 10 may be integral the printer or in a separate but operatively communicating sheet feeding module, interposer or inserter. The sheet feeding tray 14 typically will have as here at least one repositionable stack side edge guide 20, which is typically reset by the printer user up against the edge of the stack 12 when the size of the print media sheets is changed. A resettable stack end guide 30 may also be provided. Since reloading or changing print media is a frequent occurrence, it is important that it be easily and rapidly accomplished, without obstruction of the area of the sheet feeding tray 14 into which the print media is being inserted.

Turning now to the novel pneumatic stack edge fluffer system 40, as may be seen especially from FIG. 2, and also with reference to the above-cited U.S. Pat. No. 6,264,188, it is desirably has an air output 42 end maintained closely spaced from the edge of the stack 12 during its operation for effective stack "fluffing" with its airflow. The airflow may be conventionally provide from a blower 44.

It has found to be desirable to enhance the effectiveness of the stack edge fluffer system 40 for it to have, in operation, an air deflector member 46 extending from the air output end 42 area out over a portion of the top of the stack 12, as shown. However, it has been found that this air deflector member 46 in that operative position would interfere with the operator loading, or changing, the stack 12 sheet supply in the tray 14.

Here, in this stack edge fluffer system 40 embodiment, the blower 44 pneumatically connects to a telescoping, variable length, manifold 47, which is spring-loaded to extend in length in a direction extending towards the stack 12 side and the side guide 20 by a coil or other compression spring 48. The telescoping manifold 47 here is defined by two mutually slidable coaxial tubes with a stop 49 to limit its maximum extension and to prevent the spring 48 from separating the two tubes.

The stack edge fluffer system 40, and in particular its telescoping manifold 47, preferably operatively interacts with the side guide 20, as will be described. However, the side guide 20 is configured not to block the airflow from the air output end 42 of the telescoping manifold 47 when they are so engaged.

Merely as one example, as shown especially in FIGS. 2 and 4, the air output end 42 of the telescoping manifold 47 may have a first guide 42A, here a notch, engagable with a second guide, here tab 20A, extending from the outside of the side guide 20, when the side guide 20 is within range of the maximum extension of telescoping manifold 47. The air output end 42 of the telescoping manifold 47 here is effectively cantilever mounted from its other or inside end, which is mounted to the machine or module frame, not the drawer 10, not the tray 14, and not the side guide 20. Thus, the whole stack edge fluffer system 40 remains in the machine or module when the drawer 10 is opened.

Whenever the drawer 10 is opened, the tray 14 and its side guide 20 move outwardly with the drawer. This moves the side guide 20 sufficiently away from the maximum extension of the telescoping manifold 47, and thus the stack edge fluffer system 40 disengages from the side guide 20, and thus the air deflector member 46 no longer extends out over any portion of the top of the stack 12, or out over any of the stack loading area of the tray 14, even for the largest size stack 12 requiring the maximum width (rearward) resetting position of the side guide 20. Thus loading of any size stack 12 into the tray 14 is thus automatically rendered completely unobstructed by any part of the stack edge fluffer system 40. Nor is there any need to move or disconnect air hoses.

With the drawer 10 open, the tray 14 side guide(s) may be reset to the desired current stack 12 size, which stack 12 may be unobstructedly loaded therein. Then the drawer 10 may be normally closed.

Automatically during the drawer closure, with no need for operator intervention, when the now-reset inboard side guide 20 moves in to within the maximum extension range of the telescoping manifold 47, the air deflector member 46 automatically extends out over the top of the new stack 12. Then the side guide 20 tab 20A engages the first guide 42A on the outer end of the telescoping manifold 47. That mutual engagement is designed or preset to redefine the correct spacing of the air output end 42 of the telescoping manifold 47 from the side edge of the new stack 12, irrespective of its changed position. That defined and maintained spacing also insures that the edge fluffer will not obstruct sheet feeding by not touching the sheet stack.

The further inward or closing movement of the drawer 10 simply telescopes the manifold 47, compressing the spring 48, to allow the drawer 10 to fully close without obstruction and without changing said preset operative position of the pneumatic output of the stack side edge fluffer against the side of the stack.

While the embodiment disclosed herein is preferred, it will be appreciated from this teaching that various alternatives, modifications, variations or improvements therein may be made by those skilled in the art, which are intended to be encompassed by the following claims.

What is claimed is:

1. In a sheet feeding system for separating and feeding individual print media sheets in a process direction from a variable size stack of print media sheets loaded into a sheet feeding tray having at least one stack side edge alignment guide movable for alignment with said variable sizes of stacks of print media sheets, which sheet feeding tray is in a machine drawer which is openable for said loading of said variable size stacks of print media sheets into said sheet feeding tray, and which machine drawer is closable to allow said separating and feeding of said individual print media sheets from said sheet feeding tray in said process direction, the improvement comprising:

a pneumatic stack edge fluffer system for pneumatically assisting said separating and feeding of said individual print media sheets from said sheet feeding tray in said process direction, said pneumatic stack edge fluffer system automatically operatively engaging a side edge of said variable size stack of print media sheets in said sheet feeding tray in variable positions by an automatically telescoping variable length pneumatic manifold when said machine drawer is closed by automatically telescope variable length, and said pneumatic stack edge fluffer system automatically operatively disengaging a side edge of said variable size stack of print media sheets in said sheet feeding tray when said machine drawer is open.

2. The sheet feeding system of claim 1, wherein said engagement and disengagement of said pneumatic stack edge fluffer system is cooperative with said movement of said at least one stack edge alignment guide.

3. The sheet feeding system of claim 1, wherein said pneumatic stack edge flutter system includes an extension member extending out over a portion of the upper surface of said stack of print media sheets when said machine drawer is closed.

4. The sheet feeding system of claim 1, wherein, when said machine drawer is closed, said pneumatic stack edge flutter system is automatically engaged by said at least one stack edge alignment guide to automatically maintain a preset operative spacing of said pneumatic stack edge flutter system from the side edge of said stack of print media sheets irrespective of the repositioning of said stack edge alignment guide.

5. In a sheet feeding system for separating and feeding individual print media sheets in a process direction from a variable size stack of print media sheets loaded into a sheet feeding tray having at least one stack side edge alignment guide movable for alignment with said variable sizes of stacks of print media sheets, which sheet feeding tray is in a machine drawer which is openable for said loading of said variable size stacks of print media sheets into said sheet feeding tray, and which machine drawer is closable to allow said separating and feeding of said individual print media sheets from said sheet feeding tray in said process direction, the improvement comprising:

a pneumatic stack edge fluffer system for pneumatically assisting said separating and feeding of said individual print media sheets from said sheet feeding tray in said process direction, said pneumatic stack edge fluffer system automatically operatively engaging a side edge of said variable size stack of print media sheets in said sheet feeding tray in variable positions when said machine drawer is closed, and said pneumatic stack edge flutter system automatically operatively disengaging a side edge of said variable size stack of print media sheets in said sheet feeding tray when said machine drawer is open, wherein said pneumatic stack edge flutter system comprises a telescoping and spring loaded pneumatic manifold mounted in said machine and extending toward said edge of said variable size stack of print media sheets loaded into said sheet feeding tray.

6. In a sheet feeding method for separating and feeding individual print media sheets in a process direction from a variable size stack of print media sheets loaded into a sheet feeding tray having at least one stack side edge alignment guide movable for alignment with said variable sizes of stacks of print media sheets, which sheet feeding tray is in a machine drawer which is openable for said loading of said variable size stacks of print media sheets into said sheet feeding tray, and which machine drawer is closable to allow said separating and feeding of said individual print media sheets from said sheet feeding tray in said process direction, the improvement comprising:

pneumatically assisting said separating and feeding of said individual print media sheets from said sheet feeding tray in said process direction with a stack edge fluffer system by automatically operatively engaging a side edge of said variable size stack of print media sheets in said sheet feeding tray in variable positions with said stack edge fluffer system when said machine drawer is closed, and automatically operatively disengaging said pneumatic stack edge fluffer system from said side edge of said variable size stack of print media sheets in said sheet feeding tray when said machine drawer is open, wherein an air deflector for said pneumatic stack edge fluffer system is automatically extended out over a portion of the upper surface of said stack of print media sheets when said machine drawer is closed, and automatically not extended out over a portion of the upper surface of said stack of print media sheets when said machine drawer is opened to automatically provide unobstructed loading of said print media sheets into said sheet feeding tray.

7. The sheet feeding method of claim 6, wherein, when said machine drawer is closed, said pneumatic stack edge fluffer system is automatically engaged by said at least one stack edge alignment guide to automatically maintain a preset operative spacing of said pneumatic stack edge fluffer system from the side edge of said stack of print media sheets irrespective of the repositioning of said stack edge alignment guide.

* * * * *